United States Patent [19]

Simmons et al.

[11] 4,436,404

[45] Mar. 13, 1984

[54] SHEET HANDLING APPARATUS

[75] Inventors: William J. Simmons; Richard Tinder, both of Rochester, N.Y.

[73] Assignee: Eastman Kodak Company, Rochester, N.Y.

[21] Appl. No.: 309,733

[22] Filed: Oct. 8, 1981

[51] Int. Cl.[3] ..... G03G 15/14; G03G 15/22

[52] U.S. Cl. ..... 355/3 SH; 271/65; 271/186; 271/246; 355/14 SH

[58] Field of Search ..... 355/3 R, 3 SH, 14 SH, 355/23, 24, 26; 271/65, 186, 242, 245, 246

[56] References Cited

U.S. PATENT DOCUMENTS 4,019,732 4/1977 Hunt et al. ..... 271/245

4,176,945 12/1979 Holzhauser et al. ..... 355/23

4,191,465 3/1980 Boase et al. ..... 355/3 SH

*Primary Examiner*—Fred L. Braun

*Attorney, Agent, or Firm*—William F. Noval

[57] ABSTRACT

Sheet handling apparatus is provided including first and second convergent paths along which sheets are moved seriatim. A sheet engagement mechanism is located adjacent to the first path near the convergence of the two paths. A sheet guide member is mounted for movement between a first position adjacent to the first path and a second position adjacent to the second path. When the guide member is in the first position, the sheet engagement mechanism extends into the first path to register sheets moved along the first path. When the guide member is in the second position the sheet engagement mechanism is held remote from either path.

15 Claims, 4 Drawing Figures

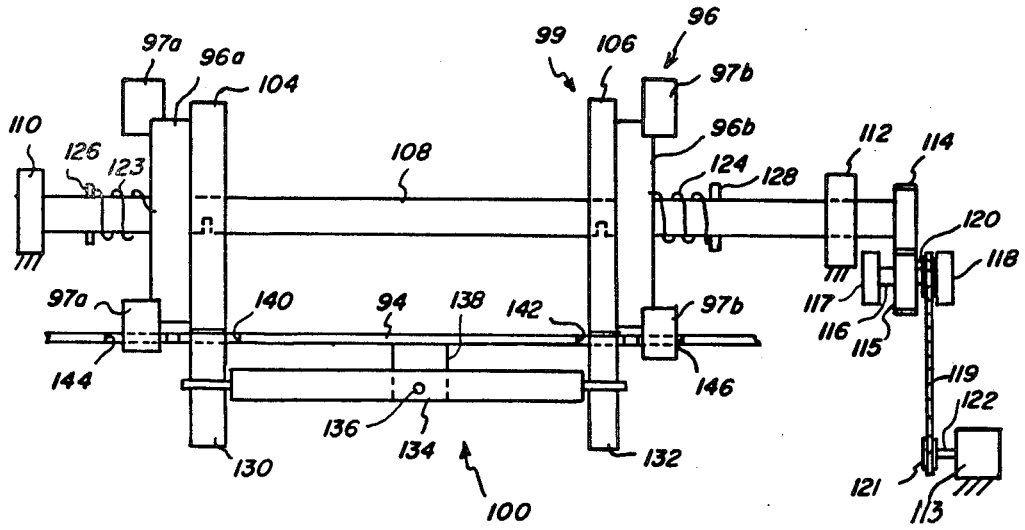
FIG. 2
FIG. 3
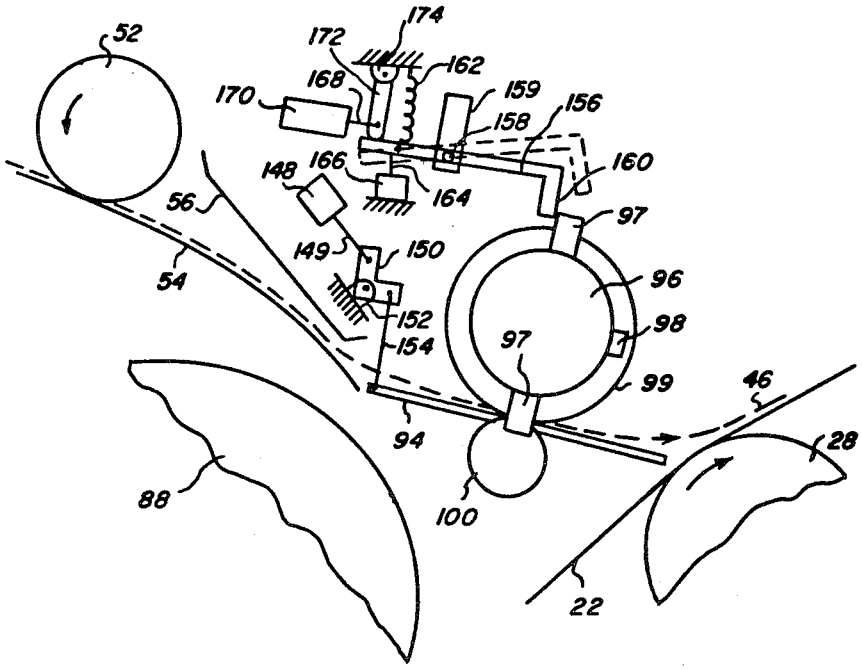

SHEET HANDLING APPARATUS

FIELD OF THE INVENTION

This invention relates to sheet handling apparatus and more particularly to apparatus for handling sheets moved along two convergent paths and for registering sheets moved along one of the paths. The apparatus is especially useful in simplex/duplex reproduction apparatus in which the sheet handling apparatus guides and registers copy sheets in the simplex mode in a first sheet path and guides copy sheets in the duplex mode in a second sheet path which converges with the first in advance of an image transfer member.

BACKGROUND OF THE INVENTION

In the simplex/duplex copier disclosed in commonly assigned U.S. Pat. Nos. 4,095,979, issued June 20, 1978 and 4,174,905, issued Nov. 20, 1979, both of which are entitled "Method and Apparatus For Producing Duplex Copies", first and second toner images are formed on a moving photoconductive belt and are transferred to the opposite sides of a copy sheet. Located along the photoconductive belt are a first image transfer station for transferring the first toner image from the belt to one side of a copy sheet, a copy sheet inverter for inverting the copy sheet after first image transfer and a second transfer station for transferring the second toner image from the belt to the other side of the copy sheet. A sheet registration device is provided in advance of the first transfer station to register either simplex or duplex copy sheets brought into contact with the photoconductive belt. When simplex copies are made the copy sheet passes under both of the transfer stations.

Commonly assigned U.S. Pat. No. 4,194,829, issued Mar. 25, 1980, entitled "Apparatus For Producing Duplex Copies" discloses apparatus for producing duplex copies in which a registration device is located between a sheet inverting belt and a second transfer station to register inverted duplex sheets. The device does not register simplex sheets.

Commonly assigned U.S. Pat. No. 4,158,500, issued June 19, 1979, entitled "Apparatus For Producing Collated Copies In Page Sequential Order"; Research Disclosure ("Research Disclosure" formerly "Product Licensing Index" is published by Industrial Opportunities Ltd., Homewell, Havant, Hampshire, U.K.) 17,579 published November, 1978, entitled "Apparatus For Producing Duplex Copies"; Research Disclosure No. 18,446 published August, 1979, entitled "Copy Sheet Diverter"; and Research Disclosure No. 18,546, published September, 1979, entitled "Copy Sheet Diverter" disclose duplex apparatus wherein copy sheet diverters are located between a copy sheet inverting belt or drum and a photoconductive belt to assist in guiding a copy sheet carrying a toner image on one side back into contact with the belt for subsequent transfer of a second toner image to the other side of the copy sheet. No registration mechanism is associated with any of these diverters.

Commonly assigned U.S. Pat. No. 4,191,465 issued Mar. 4, 1960, entitled "Apparatus For Producing Simplex or Duplex Copies"; Research Disclosure No. 17,438 published October, 1978, entitled "Apparatus For Producing Duplex Copies"; and Research Disclosure No. 18,553 published September, 1979, entitled "Control For Duplex Copier" disclose copy sheet diverters used in conjunction with copy sheet inverters to guide copy sheets along the same path in both the simplex and duplex mode. No registration devices are operatively associated with any of the disclosed diverters.

Commonly assigned U.S. Pat. Nos. 4,019,732 and 4,019,733 both of which issued Apr. 26, 1977; and both of which are entitled "Sheet Registration Mechanism"; Research Disclosure No. 18,270 published June, 1979, entitled "Registration Gate Mechanism For Recirculating Document Feeder and Document Positioner"; and Research Disclosure No. 17,322 published September, 1978, entitled "Apparatus For Registering and Feeding Documents" disclose various types of latchable registration mechanisms.

Although the disclosed sheet registration devices and diverters may be suitable for the purposes for which they were intended, none are purposes for which they were intended, none are concerned with providing apparatus for guiding copy sheets along two paths which converge and for registering a copy sheet moved along one of these paths near the region of convergence and of holding the registration device out of either path when a copy sheet is moved along the second path. More particularly, none are concerned with providing apparatus in simplex/duplex reproduction apparatus wherein in the simplex mode sheets are guided along a first path and registered just in advance of a toner image transfer station located adjacent to an image transfer member and wherein in the duplex mode copy sheets are guided along a second path which converges with the first path in advance of the transfer station. It is desirable to register copy sheets as close to the transfer member as possible to minimize skewing of the sheet between registration and contact of the sheet with the toner image carrying transfer member.

SUMMARY OF THE INVENTION

According to the present invention, sheet handling apparatus is provided including means defining first and second convergent paths along which sheets are moved seriatim. Means are located adjacent to the first path near the convergence of the first and second paths for engaging sheets moved along the first path, the engaging means being movable into and out of the first path. Guide means are located adjacent to the sheet engaging means and are movable between a first position adjacent to the first path and a second position adjacent to the second path. Moving and latching means (1) moves the guide means to its first position and latches the engaging means so that it extends into the first path to engage a sheet moved along the first path and (2) moves the guide means to its second position and latches the sheet engaging means so that is is held remote from the first and second paths.

According to an aspect of the invention, the sheet handling apparatus is provided in simplex/duplex reproduction apparatus in which, in the simplex mode, means are provided to guide sheets along a first path and to register them in advance of an image transfer member and in which, in the duplex mode, means are provided to guide sheets along a second path which converges with the first path in advance of the image transfer member.

BRIEF DESCRIPTION OF THE DRAWINGS

In the detailed description of the preferred embodiment of the invention presented below, reference is made to the accompanying drawings, in which:

FIG. 2 is a diagrammatic elevational view of the embodiment shown in FIG. 1;

FIGS. 3 and 4 are partial diagrammatic views showing the means for moving and latching.

DESCRIPTION OF THE PREFERRED EMBODIMENT

Figure 1:
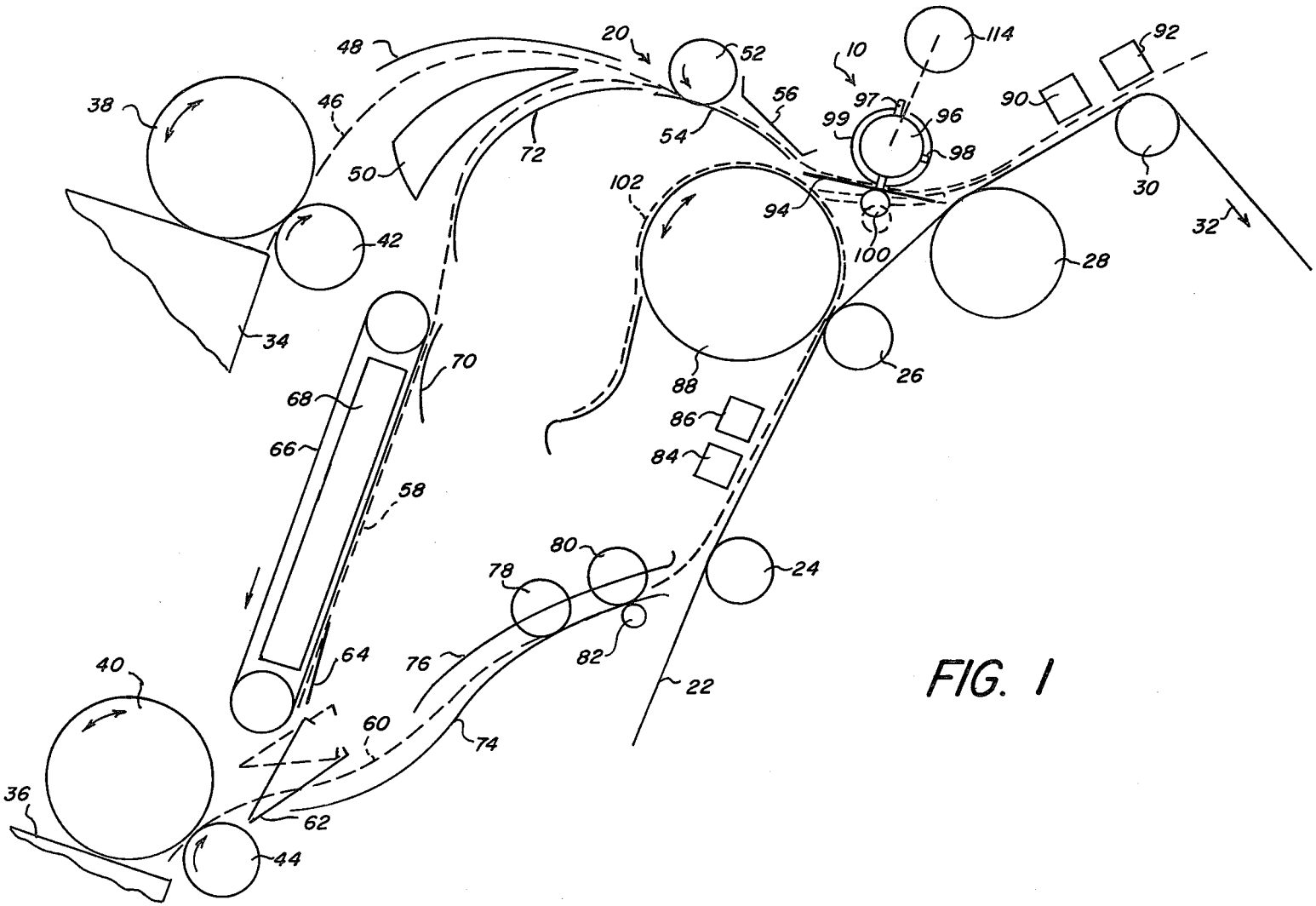
FIG. 1 is a diagrammatic view of a preferred embodiment of the present invention as used in simplex/duplex reproduction apparatus.

Referring now to the figures, there is shown a preferred embodiment of the sheet handling apparatus 10 of the present invention as used in reproduction apparatus such as electrographic copier 20 which produces simplex or duplex copies. A portion of a simplex/duplex copier is illustrated in the drawings, and for a more complete description of an exemplary electrophotographic copier, reference is made to commonly-assigned U.S. Pat. No. 4,191,465. Reference may also be made to commonly assigned U.S. Pat. Nos. 4,095,979 and 4,174,905. In FIG. 1, the portion of copier 20 shown includes a continuous photoconductive belt 22 which is trained about rollers 24, 26, 28, 30 and which is moved in the direction of arrow 32. As described in more detail in the afore-mentioned U.S. Pat. No. 4,191,465, toner images are sequentially formed on belt 22 by an electrophotographic process which includes charging belt 22 with a substantially uniform electrostatic charge, exposing the charged belt to an original to form a latent electrostatic image corresponding to the original and developing the latent image with charged toner particles to form a transferable toner image. If simplex copies are to be made, sequential toner images are transferred to the first sides only of a series of copy sheets. If duplex copies are to be made, pairs of sequential toner images are transferred to first and second sides of sequentially fed copy sheets.

As shown in FIG. 1, copier 20 includes supplies 34 and 36 of copy sheets of any suitable material such as paper, transparencies, or the like. Copy sheets are fed from the top of either supply 34 or supply 36 by means of oscillating vacuum rollers 38, 40 cooperating with rollers 42, 44 respectively. When simplex copies are made, copy sheets supplied from supply 34 are transported along a path 46 into transfer relationship with belt 22. Located along path 46 are guide members 48, 50, feed roller 52, guide members 54 and 56, and copy sheet handling apparatus 10.

Copy sheets supplied from supply 36 may be transported either along path 58 when simplex copies are made or along path 60 when duplex copies are made. Located along path 58 are deflector 62 (positioned as shown in solid lines in FIG. 1), guide member 64, vacuum belt 66 (having vacuum plenum 68), guide members 70, 72, and 50. Path 58 converges with path 46 at the nip formed by roller 52 and member 54. Thereafter, path 58 coincides with path 46 to bring a copy sheet into transfer relationship with belt 22. When duplex copies are made, deflector 62 is moved to the dotted line position shown in FIG. 1 and copy sheets are moved along path 60. Located along path 60 are deflector 62, guide members 74 and 76, feed roller 78 cooperating with guide member 76, and registration rollers 80, 82 which feed copy sheets into transfer relationship with belt 22. Rollers 78, 80, 82 may take the form of those disclosed in commonly assigned U.S. Pat. No. 4,019,733, issued Apr. 26, 1977, entitled "Sheet Registration Mechanism".

Located along belt 22 are first transfer charger 84, first detack charger 86, duplex copy sheet turnover member 88, copy sheet handling apparatus 10, second transfer charger 90 and second detack charger 92.

Copy sheet handling apparatus 10 is shown generally as including guide member 94, gate roller assembly 96, driven roller assembly 99 and idler roller assembly 100 mounted on guide member 94. Gate roller assembly 96 includes opposed registration members 97 dimensioned so as to extend into path 46 and inhibit finger 98 dimensioned so as not to extend into path 46. Guide member 94 is shown (FIG. 1) in solid lines in a first position adjacent to path 46 for guiding sheets supplied from supplies 34 or 36 into transfer relationship with a simplex toner image on photoconductive member 22 in advance of second image transfer charger 90. In this position of guide member 94, roller assembly 100 is operatively engaged with roller assembly 99 to form a nip therewith to feed copy sheets and registration member 97 extends into path 46 to engage a copy sheet moved along path 46.

Guide member 94 is movable to a second position (shown in dotted lines in FIG. 1) which is adjacent to copy sheet turnover path 102. Path 102 substantially converges with path 46 in advance of transfer charger 90. In this position, roller assembly 100 is out of engagement with roller assembly 99.

Referring to FIG. 2, there is shown in greater detail the structure of roller assemblies 99, 100, and gate assembly 96. As shown, roller assembly 99 includes a pair of rollers 104 and 106 pinned to a shaft 108 which is rotatably mounted in bearings 110 and 112. Shaft 108 and rollers 104, 106 are continuously rotated by means of a motor 113 connected to shaft 108 by means of gear 114 mounted on shaft 108, gear 115 mounted on intermediate shaft 116 (journalled in bearings 117, 118), chain 119 trained about sprocket 120 on shaft 116 and sprocket 121 on drive shaft 122 of motor 113. Gate roller assembly 96 includes rollers **96*a* and 96*b* freely rotatably mounted on shaft 108 adjacent to and in frictional contact with rollers 104 and 106 respectively. Rollers 96*a* and 96*b* are urged into engagement with rollers 104, 106 respectively by coil springs 123 and 124 coiled around shaft 108 and held by adjustable collars 126, 128 mounted on shaft 108**.

Roller assembly 100 includes rollers 130 and 132 mounted on shaft 134. Shaft 134 is pivotally supported on member 34 by pivot 136 journalled in support 138 in order to equalize the nip pressures of roller pairs 104, 130 and 106, 132. Rollers 130, 132 project upwardly through slots 140 and 142 in guide member 94 and respectively operatively engage rollers 104, 106. Registration members **97*a* and 97*b* project through slots 144 and 146 in member 94 when member 94 is positioned adjacent to path 46**.

Figure 4:
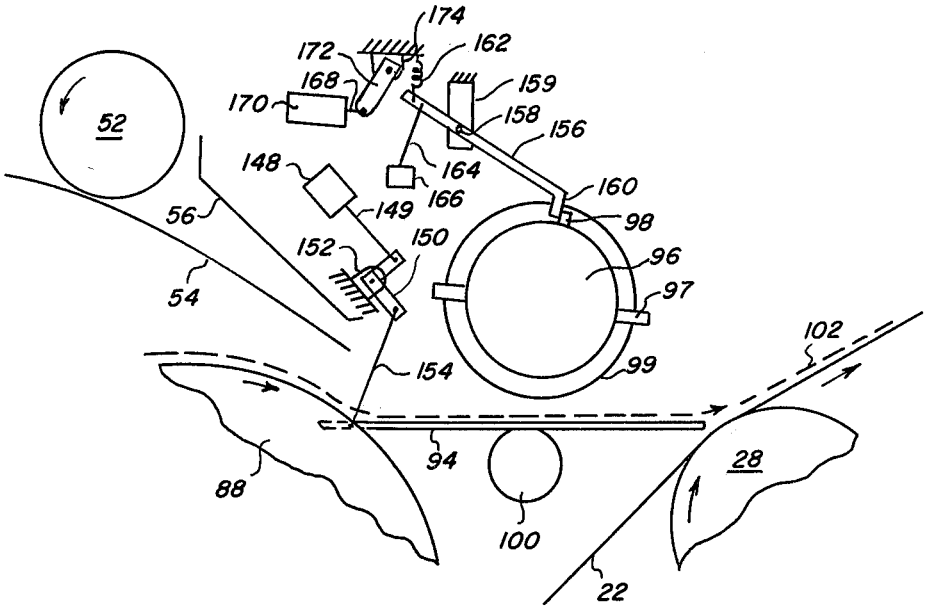

Referring now to FIGS. 3 and 4 there is shown in greater detail copy sheet handling apparatus 10. As shown, plunger 149 of solenoid 148 is operatively connected to guide member 94 (1) by bell crank 150 which is pivotally mounted on bracket 152, and (2) by link 154. A latch member 156, pivotally mounted on shaft 158 journalled in bearing 159, has a finger 160 which in a first position of member 156 (as shown in FIG. 3), engages one of the registration members 97 of gate roller 96 to maintain the other member 97 in a sheet engaging position projecting into path 46. A spring 162 normally biases member 156 into the first position. Plunger 164 of solenoid 166 is connected to latch member 156 and when actuated, moves member 156 to a second position (shown in dotted lines in FIG. 3) to disengage finger 160 from registration member 97 allowing gate roller assembly 96 to be moved out of the path of a copy sheet so that it can be advanced by rollers 99 and 100.

Plunger 168 of solenoid 170 is connected to a stop member 172 which is pivotally mounted on bracket 174 and which engages the end of latch member 156. Activation of solenoid 170 pulls plunger 168 in and pivots member 172 to the left (see FIG. 4) to allow latch member 156 to be moved (by spring 162) to a third position in engagement with latch finger 98 of assembly 96. Registration members 97 are thereby held in a position remote from either path 102 or path 46.

The operation of sheet handling apparatus 10 in copier 20 will now be described.

When copier 20 is set by an operator to make simplex copies, sequential toner images are formed on photoconductive belt 22, as for example, by the electrophotographic process disclosed in U.S. Pat. No. 4,191,465. Copy sheets are fed seriatim from either of supplies 34, 36 along paths 46, 58. Solenoid 148 is activated to hold guide member 94 in a position adjacent to path 46. Roller assembly 100 will be brought into engagement with roller assembly 96 to form a nip for advancing copy sheets. Solenoids 166 and 170 are deactivated so that stop member 172 engages latch member 156, and latch finger 160 engages one of the registration members 97 of gate roller 96 to position the other registration member 97 into path 46 to engage a copy sheet moved along path 46 just in advance of the nip formed by roller assemblies 99, 100. Since the continuously rotated rollers of assembly 99 are in frictional engagement with gate rollers 96, members 97 of rollers 96 are continuously urged out of the path of a copy sheet but are restrained by the engagement of latch finger 160 with the opposing member 97.

Solenoid 166 is then activated to release registration members 97 in synchronization with the position of a toner image on belt 22 so that a released copy sheet will be registered with a toner image on belt 22 in advance of second transfer charger 90.

When copier 20 is set by an operator to make duplex copies, first and second sequential toner images formed on belt 22 are transferred to opposite sides of a copy sheet fed from supply 36. A copy sheet from supply 36 will be transported along path 60 to registration rollers 80, 82 which will register the sheet with the first toner image on belt 22. After transfer of the first image to one side of the copy sheet by first transfer charger 84 and neutralization of any residual charge on the sheet by first detack charger 86, the copy sheet will be separated by turnover member 88 (which is rotating counterclockwise) until the sheet clears the end of guide member 94. During separation, solenoid 148 is activated to hold guide member 94 out of contact with member 88.

Turnover member 88 is then halted and solenoid 148 deactivated to cause guide member 94 to contact member 88. Member 99 may take the form of a slotted drum as disclosed in Research Disclosure No. 18,446, published August, 1979 entitled "Copy Sheet Diverter". In such case, guide member 94 would have comblike end projections which penetrate the grooves of the drum to provide a smooth sheet path from drum 88 over guide member 94. Solenoid 170 is activated to disengage stop member 172 from latch 156. Since solenoid 166 is also deactivated, spring 162 will cause finger 160 to engage finger 98 of gate 96 to hold members 97 out of the path of a copy sheet moved along guide member 94 and path 102 (FIG. 4). In such position, roller assembly 100 will also be disengaged from roller assembly 99.

Turnover member 88 is now rotated in a clockwise direction to move the copy sheet over guide member 94 unimpeded by members 97 into transfer relationship with belt 22 to receive the second toner image on the opposite side of the copy sheet by second transfer charger 90. After neutralization of any residual charges by second detack charger 92, the beam strength of the copy sheet will separate it from belt 22 at roller 30 for transport to a fusing device (not shown).

While the invention has been described in detail with particular reference to a preferred embodiment thereof, it will be understood that variations and modifications can be effected within the spirit and scope of the invention as described hereinabove and defined in the appended claims.

What is claimed is:

1. Sheet handling apparatus comprising:

means for defining first and second convergent paths along which sheets are moved seriatim;

means located adjacent to said first path near the convergence of said first and second paths for engaging sheets moved along said first path, said means being moveable into and out of said first path;

guide means located adjacent to said engaging means for guiding a sheet moved along one of said paths, said guide means being moveable between a first position adjacent to said first path and a second position adjacent to said second path; and means (1) for moving said guide means to said first position and for latching said engaging means so that it extends into said first path to engage a sheet moved along said first path; and (2) for moving said guide means to said second position, and for latching said engaging means so that it is held remote from said first and second paths.

2. The apparatus of claim 1 including first and second sheet moving means for moving a sheet along said first path wherein said first sheet moving means is fixedly mounted in relation to said first path, and said second sheet moving means is supported by said guide means so that when said guide means is at the first position, the second sheet moving means is in operative relationship with said first sheet moving means to move a copy sheet along said first path and when said guide means is at the second position, the second sheet moving means is out of operative relationship with the first sheet moving means.

3. The apparatus of claim 2 wherein said first and second sheet moving means respectively include first and second roller means which form a nip for moving copy sheets along the first path when said guide means is at the first position.

4. Sheet handling apparatus comprising:

means for defining first and second convergent paths along which sheets are moved seriatim;

a rotatable gate roller assembly located adjacent to said first path near the convergence of said first and second paths, said gate roller assembly having at least one registration member which selectively extends into said first path to register sheets moved along said first path;

means for continuously urging said gate roller assembly to rotate;

guide means located adjacent to said gate roller assembly for guiding a sheet along one of said paths, said guide means being movable between a first position adjacent to said first path and a second position adjacent to said second path; and means (1) for moving said guide means to said first position and for latching said gate roller assembly against the rotational urging of said urging means so that said registration member extends into said first path to register a sheet moved along said first path, and (2) for moving said guide means to said second position and for latching said gate roller against the rotational urging of said urging means so that said registration member is held remote from said first and second paths.

5. The apparatus of claim 4 wherein said means for urging includes a continuously rotated first roller assembly in urging engagement with said gate roller assembly, and a second roller assembly mounted on said guide means such that when said guide means is in the first position said second roller assembly cooperates with said first roller assembly to move a sheet along said first path.

6. The apparatus of claim 4 wherein said gate roller assembly includes an inhibit finger and wherein said means for moving and latching includes latch means moveable between a first latch position for latching said gate roller assembly so that said registration member extends into said first path and a second latch position engaging said inhibit finger so that said registration member is held remote from said first and second paths.

7. The apparatus of claim 6 wherein said gate roller assembly includes a second registration member spaced from said first registration member and said inhibit finger is located between said first and second registration members and wherein in said first latch position said latch means engages one of said first and second registration members, the other of said registration members extending into said first path.

8. The apparatus of claim 7 wherein said first and second registration members and said inhibit finger extend radially from said gate roller assembly with said inhibit finger extending a shorter distance than said registration members, wherein said urging means includes a set of sheet moving rollers and wherein said latch means is moveable to a third position out of latching engagement with said one registration finger to permit rotation of said gate roller assembly by said urging means to allow a registered sheet to be moved along said first path by said sheet moving rollers.

9. The apparatus of claim 8 wherein said latch means includes a pivotally mounted latch member rotatable between said first, second, and third positions and a moveable stop engaging said latch member to prevent it from being rotated to the second position to engage said inhibit finger.

10. The apparatus of claim 9 including means for biasing said latch member into said first and second positions, and wherein said means for moving and latching includes a first solenoid which, when activated, moves said latch member between said first and third positions and a second solenoid for moving said stop out of engagement with said latch member when said first solenoid is deactivated to allow said latch member to be biased by said biasing means into said second position.

11. In simplex/duplex reproduction apparatus including a supply of copy sheets, a moveable image transfer member and a copy sheet turnover member located adjacent to the image transfer member for turning over duplex copy sheets, sheet handling apparatus comprising:

means for defining a first sheet path for simplex copy sheets from said copy sheet supply to said image transfer member;

means for defining a second sheet path for duplex copy sheets from said turnover member to said transfer member, said second path converging with said first path;

guide means for guiding a sheet along one of said paths, said guide means being moveable between a first position adjacent to said first sheet path and a second position adjacent to said second sheet path;

means located adjacent to said first sheet path near the convergence of said first and second paths for engaging a simplex copy sheet which is moved along said first path;

means for continuously urging said means for engaging out of said first path;

means (1) for latching said sheet engaging means to prevent said engaging means from being urged out of said sheet path when said guide means is at said first position so that said engaging means engages a sheet moved along said first path and (2) for latching said sheet engaging means out of said sheet engaging postion against the urging of said urging means when said guide means is at its second position; and means for unlatching said latching means when said guide means is at the first position so as to allow said sheet engaging means to be urged out of said first path enabling passage of the engaged sheet along said first path into contact with said image transfer member.

12. The apparatus of claim 11 wherein the means for engaging includes a rotatably mounted gate roller having first and second spaced registration members dimensioned so as to extend into said first path and an inhibit finger located between said registration members and dimensioned so as not to extend into said first path, wherein said latch means includes a latch member mounted for movement between a first position at which it engages one of said gate roller registration members to latch said gate roller in a sheet engaging position to engage sheets moved along said first path and a second position at which it engages said inhibit finger to latch said gate roller so that neither registration member extends into said first path.

13. The apparatus of claim 11 wherein the reproduction apparatus includes means for forming transferable images on the image transfer member and an image transfer station located adjacent to the image transfer member and wherein said first and second paths converge in advance of said image transfer station.

14. In reproduction apparatus including a supply of copy sheets, a moveable image transfer member and a copy sheet turnover member located adjacent to the image transfer member, copy sheet handling apparatus comprising:

means for defining a first copy sheet path from said supply to said image transfer member;

means for defining a second copy sheet path from said turnover member to said image transfer member, said second path converging with said first path;

guide means located between the image transfer member and the copy sheet turnover member for guiding a copy sheet into contact with the image transfer member;

means for moving said guide means between a first position adjacent to said first path for guiding copy sheets moved seriatim along said first path from said supply into contact with said image transfer member, and a second position adjacent to said second path for guiding copy sheets handled by said turnover member along said second path into contact with said image transfer member;

first and second copy sheet moving means for moving a copy sheet along said first path wherein said first sheet moving means is fixedly mounted in relation to said first path, and said second sheet moving means is supported by said guide means so that when said guide means is at the first position, the second sheet moving means is in operative relationship with the first sheet moving means to move a copy sheet along said first path and when said guide means is at the second position, the second sheet moving means is out of operative relationship with the first sheet moving means.

15. The apparatus of claim 14 wherein said first and second copy sheet moving means respectively include first and second roller means which form a nip for moving copy sheets along the first path when said guide means is at the first position.

* * * * *